US005238721A

United States Patent [19]

Nakazawa

[11] Patent Number: 5,238,721

[45] Date of Patent: Aug. 24, 1993

[54] TITLE STRUCTURE AND METHOD FOR APPLYING TITLE

[75] Inventor: Masahiro Nakazawa, Tokyo, Japan

[73] Assignee: Kabushiki Kaisha PC Planning, Tokyo, Japan

[21] Appl. No.: 561,640

[22] Filed: Aug. 2, 1990

[30] Foreign Application Priority Data

Aug. 8, 1989 [JP] Japan ..... 1-93174[U]

[51] Int. Cl.[5] ..... B32B 3/10

[52] U.S. Cl. ..... 428/44; 428/48; 428/49; 428/50; 428/52; 428/138; 428/255; 52/384; 52/385; 52/386; 52/387; 52/388; 52/389; 52/390; 52/391; 52/392; 156/71; 156/299; 156/304.1; 156/313

[58] Field of Search ..... 428/48, 49, 50, 52, 428/44, 138, 255; 52/384–392; 156/71, 299, 313, 304.1

[56] References Cited

U.S. PATENT DOCUMENTS

| | | | |
|---|---|---|---|
| 2,052,229 | 8/1936 | Hyde | 52/308 |
| 2,835,623 | 5/1958 | Vincent | 52/308 |
| 2,887,867 | 5/1959 | Burchenal | 52/388 |
| 3,646,180 | 2/1972 | Winnick | 428/49 |
| 4,005,954 | 2/1977 | Hinsche | 156/71 |
| 4,415,616 | 11/1983 | Angioletti | 428/48 |
| 4,484,574 | 11/1984 | Derusha | 428/40 |
| 4,567,704 | 2/1986 | Bernett | 428/49 |
| 4,681,786 | 7/1987 | Brown | 428/49 |
| 4,832,995 | 5/1989 | McLauchlin | 428/49 |
| 4,862,668 | 9/1989 | DeGooyer | 52/390 |

*Primary Examiner*—Ellis P. Robinson
*Assistant Examiner*—Nasser Ahmad
*Attorney, Agent, or Firm*—Nikaido, Marmelstein, Murray & Oram

[57] ABSTRACT

A tile structure and method for applying tiles to the floor surface of offices, corridors and various rooms in which the surface of a floor to be tiled is covered with a sheet and peripheral side of tiles to be applied are surrounded with an elastic joint material. The tiles are applied side by side in sequence on the sheet with the elastic joint material forming a joint between adjacent tiles and in a compressed condition so as to prevent such applied tiles from moving each other. The sheet prevents the tiles from sliding along the floor surface.

3 Claims, 1 Drawing Sheet

TITLE STRUCTURE AND METHOD FOR APPLYING TITLE

BACKGROUND OF THE INVENTION

1. Field of the Invention

This invention relates to a tile floor structure and method for applying such tile structure to floor surface of offices, corridors and various rooms.

2. Description of the Prior Art

Conventionally, there has been known a so-called wet-type attaching method in which tiles are stuck and fixed on surface of floors or the like formed with concrete, etc. with use of a mortar. As a dry-type attaching method, several methods have been known such as a method which prepares a sheet on which several tiles are adhered beforehand and sticks the sheet on floors with use of adhesives, and a method which projects legs on the back of tiles, puts the legs into holes provided on floor surface and fixes tiles with use of adhesives.

The above wet-type method is an effective method in the case where water-resistance and strength are required, for example, bathroom, lavatory, etc. where a large amount of water is flowed and places where heavy loads are repeatedly effected. However, the method is, in the cases other than the above-mentioned case, not economical because of the necessity of skilled workers in construction, a long term of work and high cost.

Even in the above-mentioned dry-type method which was developed for eliminating the defects of the wet-type method, it is necessary to put joint materials in a space between tiles after tile attachment. Further, the method of putting the legs projected on the back of tiles in the holes of floor surface involves the drawback that the formation of legs on the back of tiles makes the cost higher.

Both methods as mentioned above involve a problem that reattachment of tiles cannot be easily conducted.

SUMMARY OF THE INVENTION

In order to solve above problems, the present invention relates to a structure and method for applying tiles to a floor surface by interposing a joint material between the tiles, wherein the floor surface is first covered with an elastic sheet, while a peripheral side of a tile is surrounded with an elastic joint material, and then these tiles are set side by side in sequence on the sheet.

By using the present invention, applying of tiles can be conducted economically because of the shorter term of work and lower cost as compared with the wet-type method and dry-type method. Besides, the applying can be easily conducted by amateurs without employing professional tilers or plasterers. The term of work can be shortened to about one half of that of the conventional dry-type method which has been relatively shorter.

Moreover, according to the present invention, re-applying of tiles covering the floor surface can be easily carried out. For example, if floors of event places, and the like, are covered with tiles of the present invention, re-applying of tiles can be made by freely changing materials, colours, designs, etc. of tiles, joint materials, etc. depending on the kind of events and/or seasons. Respective tiles can be used by changing their arrangement on the same floor surface or applying them to a different floor surface. Further, different designs can be made by appropriately combining several kinds of tiles and changing their arrangement.

DETAILED DESCRIPTION OF THE PREFERRED EMBODIMENT

Figure 1:
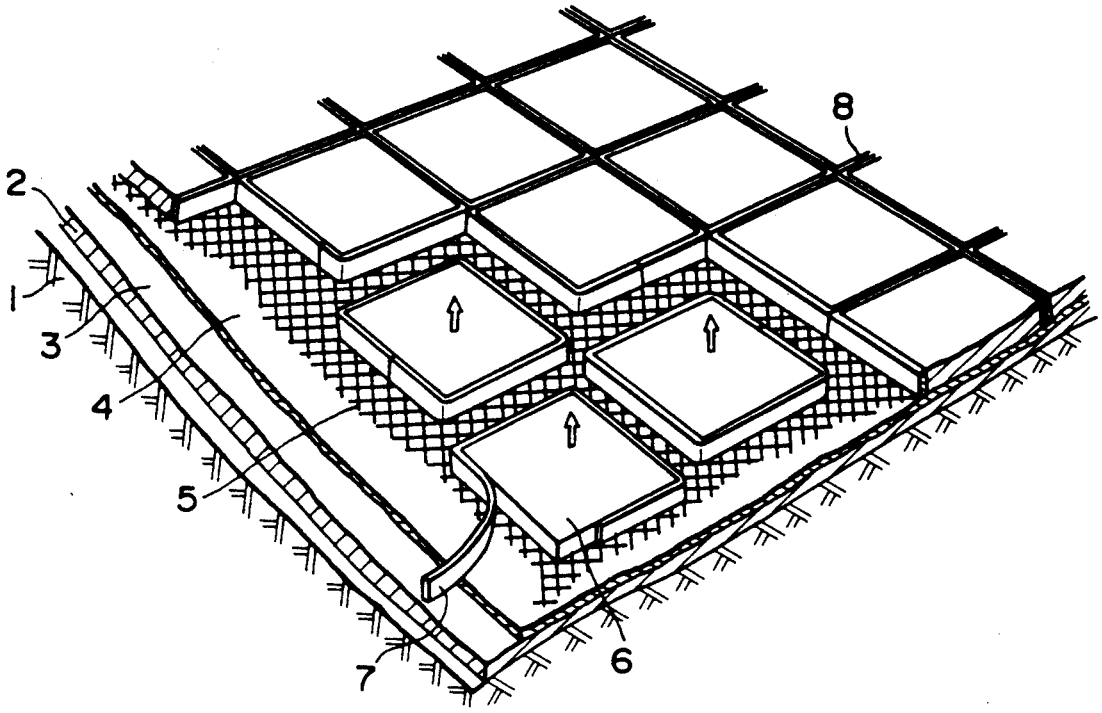
FIG. 1 is a partially cutaway view in perspective of tiles of the present invention as being applied.

Before applying the tiles, a substantially plane floor surface is first prepared according to ordinary methods. FIG. 1 shows an example thereof in which a floor surface 3 made smooth and flat with use of a self-levelling material 2 is formed on a floor base 1 made of concrete, mortar or wood. The self-levelling material 2 is formed with thermoplastic synthetic resin materials, flowed in the melting condition on the whole surface of the floor base 1, and solidified into ceramic-like state in a short period of time of about 3 to 4 hours to make the surface smooth and horizontal. Furthermore, when the above mentioned floor base 1 is made of wood such as plywood, etc., the self-levelling material may not be used, or a level adjusting plate (not shown in drawing) may be used to form a horizontal surface.

It is preferable to cover the above-mentioned floor surface 3 with calcium carbonate paper having hygroscopic property as an underlay material 4. When the tiles are applied and fixed on the underlay material 4, the material 4 makes the removal of the tiles from the floor easy. Furthermore, when the floor base is made of wood, the underlay material 4 can be released from the effects of expansion and contraction of the wood.

Figure 3:
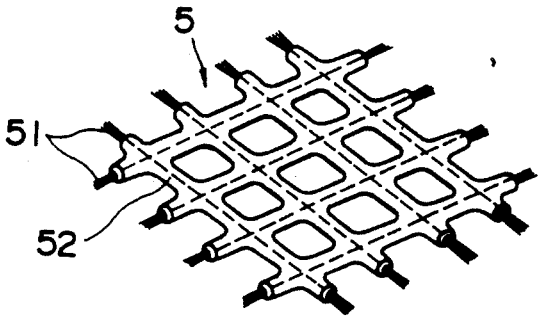
FIG. 3 is an enlarged, partially cutaway view in perspective of a sheet used in the tile application in FIG. 1.

On the whole upper surface of the underlay material 4, a sheet 5 having pertinent elasticity is applied. As shown in FIG. 3, the sheet 5 is prepared by forming a coating layer 52 by use of rubbers, synthetic resins or foamed type thereof with high elasticity on a net-like knitted core material 51 made from glass fibers or strands of synthetic resins.

Figure 2:
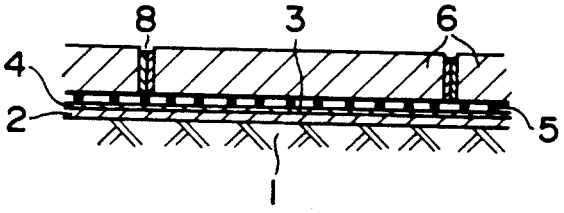
FIG. 2 is an enlarged sectional view of a part of FIG. 1.

On the sheet 5, as shown in FIG. 1 and FIG. 2, substantially square, earthenware tiles 6 are set side by side in sequence from the peripheral partition face of edge portion of the floor surface 3 (not shown in drawing). At this time, the whole peripheral sides of each tile 6 is surrounded with a joint material 7. The joint material is made of elastic foamed resin material formed in a tape shape with a width being the same as or a little narrower than the plate thickness of the tile 6. By applying these tiles 6 in sequence, while pressing the joint material 7, adjacent tiles are put in a compressed condition in a horizontal direction to each other. In this instance, it is convenient to surround and fix the tape around the periphery of the tiles with an adhesive layer on the one side of the joint material 7 to be applied to the tile beforehand. It is further preferable to provide another adhesive layer on an opposite side of the tape of the joint material to adhere the joint material of adjacent tiles to each other.

The joint material 7 forms a joint 8 between adjacent tiles with a thickness under a compressed condition. The joint serves to elastically prevent the applied tiles from moving laterally of each other or lifting upward.

In the example illustrated in drawing, the tile has a length and a width of 65 mm, respectively, and a thickness of 8 mm, and the joint material 7 is a tape with 1.5 mm thickness and 7 mm width, made of closed-call foamed resin with an adhesive layer on one side. When respective tiles are attached, the joint material is pressed so as to make the thickness of the joint between tiles about one half the total thickness of the tape, i.e., make the width of the joint 8 between the tiles after the tiles are applied about 1.5 mm. As a result, in the joint 8, substantially no contact line in the joint material 7 is recognized in the appearance of the applied tiles. When the above joint material 7 is used for square tiles of pottery with length and width of 300 to 450 mm, respectively, and a thickness of 8 to 10 mm, a similar stable floor surface is obtained.

As mentioned above, tiles 6 applied to the floor surface 3 are prevented from moving laterally and lifting from the floor by the joint material. Also, since respective tiles are mounted in such a condition that the sheet 5, having elasticity, is pressed slightly, lateral moving of tiles are prevented by friction between the tiles and the sheet. Thus, when people walk on the tiles, even if the tiles slightly move laterally or lift upward, the tiles will elastically return to the original applied position. The sheet also gives appropriate elasticity to the floor itself when people walk on the tiles.

The shape of the tile may be rectangle, regular polygon, other polygons or arc, other than square, as mentioned above. In summary, it is desirable to have a tile with such a shape that the width of the joint formed between peripheries of a tile and adjacent tiles may become parallel or constant. Similarly, the material of tile is not limited to pottery, but various materials are widely used so far as if has constant rigidity, for example, synthetic resin materials, natural stones, woods, corks, synthetic resin materials coated with a carpet thereon, etc.

In addition to the case where the joint material is surrounded around all tiles, as in the above example, the joint material may be surrounded around every other tiles to be applied so as to form a joint material on adjacent tiles. Further, synthetic resin paste may be coated on a periphery of the tile and solidified elastically to integrate the tile and the joint material.

As the sheet, in addition to the above, a sheet formed with synthetic resins or rubbers may be used. It is also possible to apply a coating material, having elasticity, to a floor surface, to stick a synthetic resin or rubber sheet, or to coat elastic material to a back of the tiles. As mentioned above, the sheet can at least prevent the attached tiles from moving laterally, and more preferably can give constant elasticity to tiles.

There is a case where the attached tiles are vertically moved through elasticity of the sheet 5 to make a noise, when the attached tiles receives load. Such case may be improved as follows:

Namely, in the stage of attaching the sheet 5, adhesives such as plaster and powdery self-levelling material are uniformly sprayed on the sheet 5 into a thin layer, and thereafter a solvent (i.e., water) of plaster or self-levelling material is sprayed on the sheet 5. Then, when the tiles are attached to the resultant surface of the sheet 5, the tiles are fixedly adhered to the sheet 5 to thereby restrain the generation of noise. In this case, the elasticity given to the tiles is made somewhat lower.

What is claimed is:

1. A tile floor structure comprising a flat floor surface, tiles disposed thereon and a joint interposed between adjacent of said tiles, wherein:

(a) said tiles have a shape such that a periphery of one of said tiles is adjusted to the peripheries of adjacent of said tiles by a joint;

(b) peripheries of said tiles are provided with an elastically compressible joint tape wherein said joint tape is a closed-cell foamed resin, said joint tape forming said joint at said peripheries of adjacent tiles in an elastically compressed condition when said tiles are applied to said flat floor surface and having elasticity when so compressed for preventing said tiles from moving laterally and lifting relative to said floor surface; and (c) an elastic sheet interposed between said floor surface and said tiles, having a bottom face in contact with said floor surface and an upper face in contact with backs of said tiles such that said elastic sheet prevents the tiles from moving laterally with respect to said floor surface.

2. A method for applying tiles comprising the steps of:

(a) preparing tiles having a shape such that a periphery of one of the tiles is adjusted to peripheries of adjacent of said tiles through a joint having constant width;

(b) providing a sheet having elasticity on a floor surface made flat by flowing a thermoplastic synthetic resin material in a melting condition and by solidifying said resin material;

(c) surrounding the peripheries of the respective contact tiles with joint materials having elasticity; and (d) setting the tiles surrounded with said joint materials so that the back surface of the tiles is in contact with the sheet and said joint materials surrounding the peripheries of the tiles are also in contact with each other and compressed forming a joint between said tiles for preventing said tiles from moving laterally and lifting relative to said sheet.

3. The method for applying tiles according to claim 2, wherein said tiles are applied such that said joint materials having elasticity are put in a compressed condition to one half thickness.

* * * * *